United States Patent [19]

Osborne

[11] Patent Number: 4,702,409

[45] Date of Patent: Oct. 27, 1987

[54] TRAY WITH REINFORCED CORNERS

[75] Inventor: Edward L. Osborne, Kansas City, Kans.

[73] Assignee: Westvaco Corporation, New York, N.Y.

[21] Appl. No.: 884,095

[22] Filed: Jul. 10, 1986

[51] Int. Cl.[4] ..... B65D 5/30

[52] U.S. Cl. ..... 229/125; 206/815; 229/41 R; 229/143; 229/149; 229/169; 229/174; 229/DIG. 11

[58] Field of Search ..... 229/125, 142, 143, 149, 229/152–154, 169, 174, 41 R, 41 B, DIG. 11; 206/815

[56] References Cited

U.S. PATENT DOCUMENTS

| | | | |
|---|---|---|---|
| 1,910,480 | 5/1933 | Shoemaker | 229/169 |
| 1,916,119 | 6/1933 | Schwartz et al. | 206/815 |
| 2,480,587 | 8/1949 | Marshall et al. | 229/143 |
| 2,835,431 | 5/1958 | Stone | 229/143 |
| 2,914,236 | 11/1959 | Shapiro | 206/815 |
| 3,152,748 | 10/1964 | Desmond et al. | 229/41 B |
| 3,727,827 | 4/1973 | Stice | 229/125 |
| 4,537,344 | 8/1985 | Thomas | 229/143 |

FOREIGN PATENT DOCUMENTS

| | | | |
|---|---|---|---|
| 1246891 | 10/1960 | France | 229/174 |
| 2043596 | 10/1980 | United Kingdom | 229/DIG. 11 |

*Primary Examiner*—Stephen Marcus
*Assistant Examiner*—Gary E. Elkins

[57] ABSTRACT

A collapsible tray is formed from a single blank of cut and scored foldable material and comprises a generally rectangular bottom panel, side walls extending from opposite sides of the bottom panel and end walls extending from opposite ends of the bottom panel. Corner connecting flaps are provided at each end of the side walls and abbreviated top panels are foldably attached to the upper edges of the side walls. The top panels also include corner reinforcing flaps located at each respective end. The corner connecting flaps are adhered to the inner surfaces of the end walls at each corner and the corner reinforcing flaps are folded downward inside the tray to overlap the corner connecting flaps. The corner reinforcing flaps are retained in place when tabs included on the ends thereof are inserted in slots provided in the bottom panel and with the aid of additional locking tabs provided on the corner connecting flaps which are accessed by openings provided in the end walls.

1 Claim, 5 Drawing Figures

Fig 3.
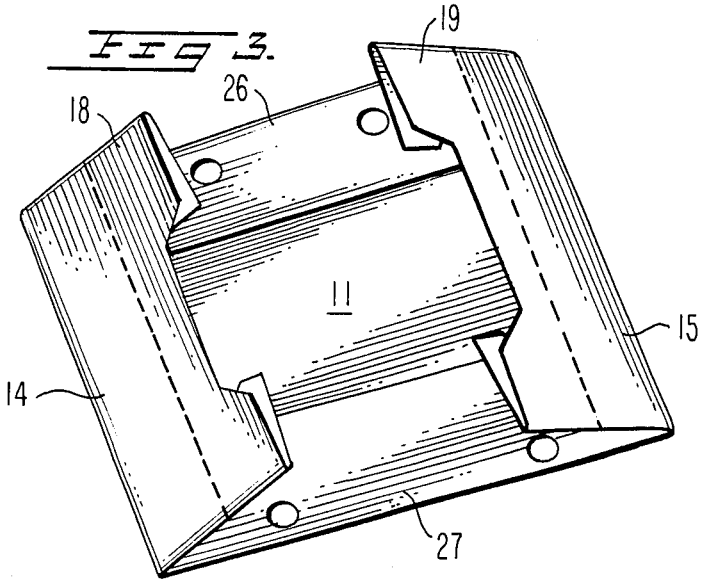
Fig 4.
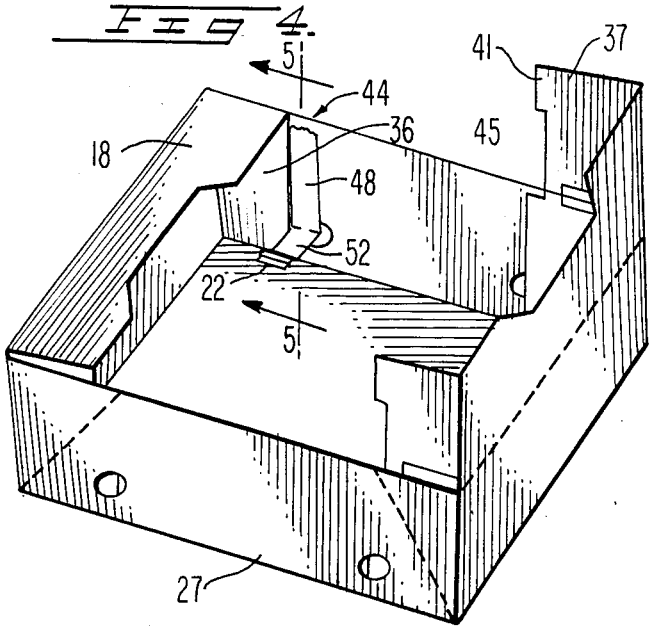
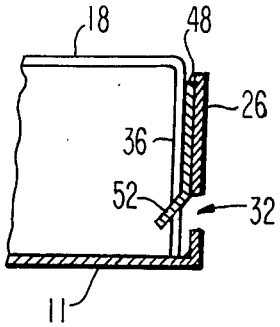
Fig 5.

TRAY WITH REINFORCED CORNERS

BACKGROUND OF THE INVENTION

The present invention relates generally to trays and more particularly to a collapsible tray with reinforced corners for use in packaging perishable products such as fruits and vegetables.

Most of the trays of this type currently available are set up and glued at the point of manufacture or at the point of use by special tools and equipment. During the final assembly operation of known trays, connections are formed between the side and end panels to produce a rigid product. Such trays when empty are difficult to stack since they won't nest.

It would be desirable, therefore, to have a collapsible tray for convenience in shipping which can readily be set up for use by hand at the point of use.

SUMMARY OF INVENTION

The present invention comprises a collapsible tray having a substantially rectangular bottom panel, side walls extending upwardly from opposite sides of the bottom wall and end walls extending from opposite sides of the bottom wall. Corner connecting flaps are provided at each end of the side walls which are folded inside and adhered to the inner surfaces of the end walls at each corner. The end walls include diagonally oriented score lines which extend from the corners where the end walls are connected to the bottom panel upwardly and outwardly to the upper edges of the end walls terminating at a point which corresponds to the location of the upper edges of the corner connectng flap adhered thereto. These score lines permit the end walls and side walls to be collapsed onto the bottom panel for shipping and storage. A pair of top panels of abbreviated length are foldably attached to the upper edges of the respective side walls and corner reinforcing flaps are foldably attached to each end of the top panels. During the manufacturing and shipping conditions, the corner reinforcing flaps remain temporarily attached to the corner connecting flaps by connectors which maintain these flaps at each corner of the tray generally in the same plane. The connectors are necessary to permit the tray walls to be readily collapsed for shipment and storage. When it is desired to set up the tray for use, the side and end walls are urged upwardly with the top panels acting as extensions of the side walls and the corner reinforcing flaps as extensions of the end walls. After the tray is filled, the connectors are broken and the corner reinforcing flaps are folded downwardly inside the tray so as to overlap the corner connecting flaps. The corner reinforcing flaps are retained in place when tabs included on the outer ends thereof are inserted in slots provided in the bottom panel. In addition, the corner reinforcing flaps are locked in place by tabs provided on the corner connecting flaps which are accessed by openings provided in the end walls adjacent to the tabs.

Accordingly it is an object of the present invention to provide a tray-type shipping package which can be glued and collapsed for shipment at the point of manufacture, and readily set up for use when needed without special tools or equipment.

It is another object of the present invention to provide in such a package a readily available corner reinforcing feature which can be activated after the package is filled and locked in place via a locking means accessed from outside the package.

It is yet another object of the present invention to provide in such a package top panels of abbreviated length along each side wall to enhance the stacking ability of the trays. These and other desirable objects and features will become apparent from the accompanying drawings and detailed description.

DESCRIPTION OF DRAWING

FIG. 3 is a perspective view of the tray collapsed for shipment prior to use;

FIG. 4 is a perspective view of the tray with the corner reinforcing flaps at one side folded and locked in place; and, FIG. 5 is an enlarged view taken along the lines 5—5 of FIG. 4 showing details of a corner reinforcing flap locked in place.

DETAILED DESCRIPTION

Figure 1:
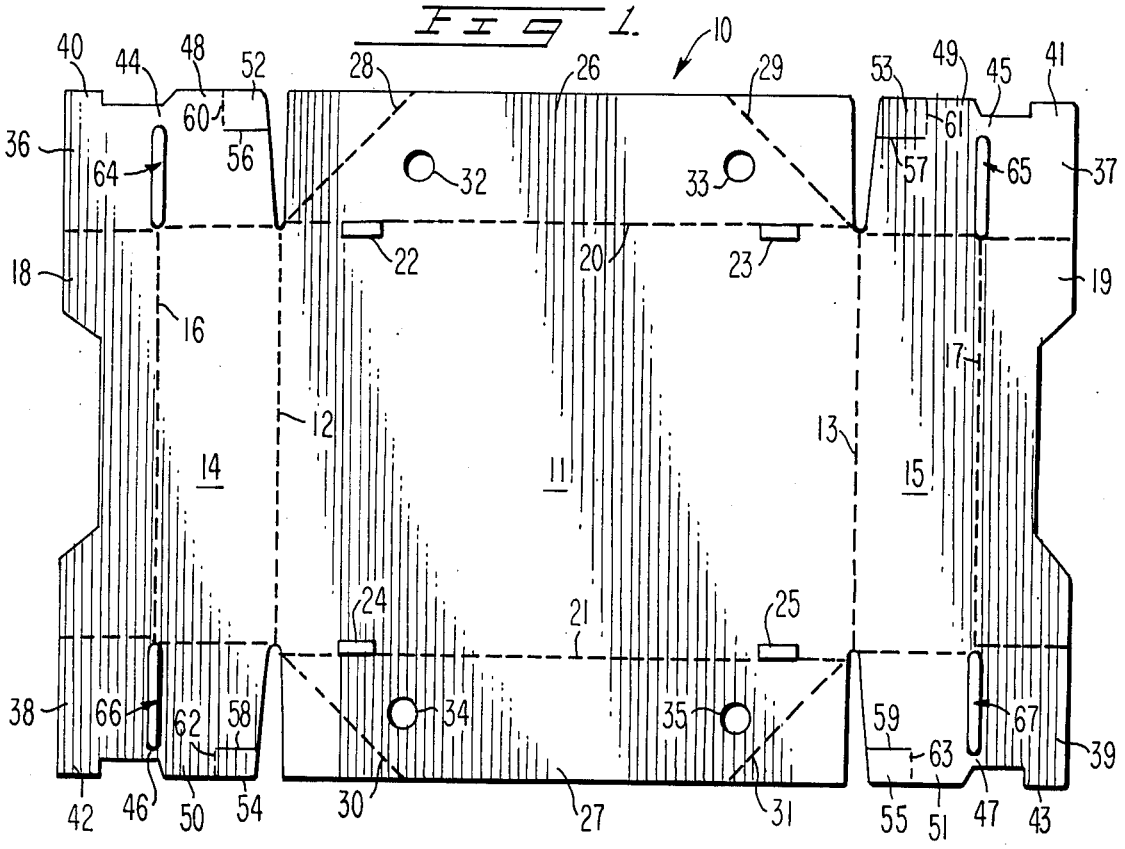
FIG. 1 is a plan view of a typical blank structure for use in preparing the tray of the present invention.

FIG. 1 illustrates a typical blank structure for use in forming the tray of the present invention. The blank 10 includes a substantially rectangular bottom panel 11, two side walls 14, 15 foldably attached to opposite sides of the bottom panel along fold lines 12 and 13, and a pair of end walls 26,27 foldably attached to the opposite ends of the bottom panel along fold lines 20 and 21. In addition to these elements, a pair of top panels 18,19 of abbreviated width are foldably attached to the edges of the side walls 14,15 along score lines 16 and 17. The top panels 18 and 19 are designed to have a combined width that is less than the width of the tray between the side walls 14 and 15 so as to provide only partial cover for the contents of the tray, and yet to provide stacking ability to the trays. Meanwhile, each of the side walls 14 and 15 are provided with corner connecting flaps 48,49,50 and 51 at each end thereof, and the top panels include corner reinforcing flaps 36,37,38 and 39 at each end thereof. Each of the corner connecting flaps and corner reinforcing flaps are spaced from one another along a majority of their adjacent edges by slots 64,65,66 and 67, but remain attached to one another at their outer ends via connector elements 44,45,46 and 47 throughout the construction of the tray. The corner reinforcing flaps 36,37,38 and 39 each include tab elements 40,41,42 and 43 at their outer ends which are adapted to engage slots 22,23,24 and 25 located along the score lines 20 and 21 of the bottom panel 11. In addition, the corner connecting flaps are each provided with locking tabs 52,53,54 and 55 which are accessed from outside the tray by openings 32,33 and 34,35 located in the tray end walls 26 and 27 respectively. These tabs are formed by cut lines 56,57,58 and 59 and score lines 60,61,62 and 63 which intersect one another at generally right angles in the end of each corner locking flap. Finaly, the end walls 26,27 also include diagonally oriented score lines 28,29,30 and 31 at each corner which permit the assembled tray to be folded flat for shipping and storage.

Figure 2:
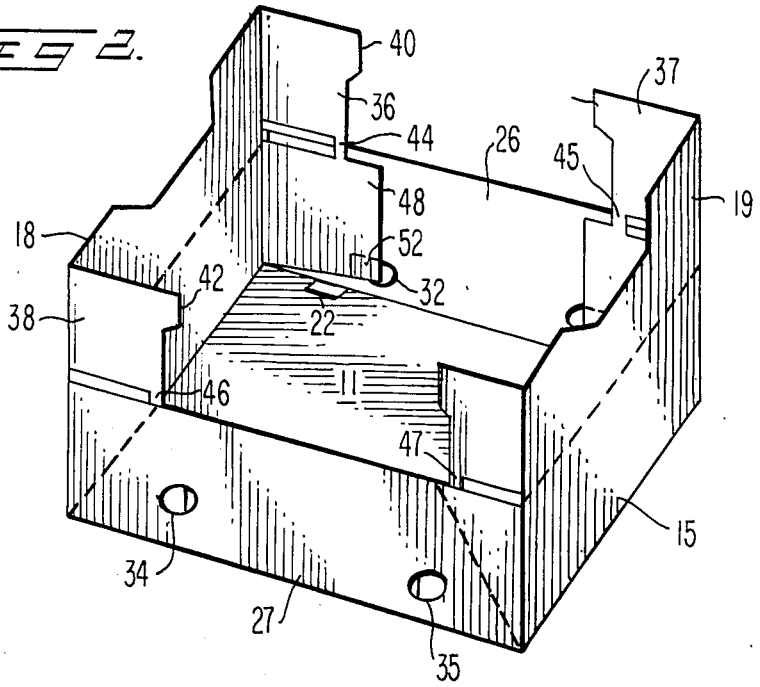
FIG. 2 is a perspective view of the tray formed from the blank of FIG. 1 set up for use.

In the assembled condition of the tray as shown in FIG. 2, the corner connecting flaps 48,49,50 and 51 are folded inside and adhered to the inner surfaces of the end walls 26,27. In this condition, the corner reinforcing flaps 36,37,38 and 39 extend above the top of the tray substantially in the same planes as each attached corner connecting flap 48,49,50 and 51 because of the presence of the connector elements 44,45,46 and 47. At this point in the assembly, the tray end walls 26,27 may be folded inwardly as shown in FIG. 3 along the diagonal score lines 28,29 and 30,31 to produce a collapsed tray suitable for shipment and storage in a minimum of space.

At the point of use, the end walls 26,27 are folded upwardly and the tray is filled. The erect condition of the top panels 18,19 and the corner reinforcing flaps 48,49,50 and 51 allows the tray to be readily filled before the corner reinforcing flaps are folded into position at each corner. FIG. 4 illustrates the tray with one top panel 18 and its adjacent corner reinforcing flaps 36 and 38 folded downward and locked in position. For this purpose the connector elements 44 and 46 are broken and the corner reinforcing flaps 36,38 are folded downwardly so that the tabs 40 and 42 on the ends thereof become engaged in the slots 22 and 24 provided therefor in bottom panel 11. At the same time, the corner reinforcing flaps 36,38 are retained or locked in position by the locking tabs 52 and 54 provided on corner connecting flaps 48 and 50. These tabs are accessed from outside the filled tray through the openings 32 and 34 provided in end walls 26,27. The corner reinforcing flaps 48,49,50 and 51 are sized so that the leading edges lie just behind the cut edges 56,57,58 and 59 of locking tabs 52,53,54 and 55. Thus, as shown in detail in FIG. 5, when the corner reinforcing flap 36 is folded into place, the locking tab 52 can be pushed into locking engagement through the opening 32 by the users finger or a suitable instrument.

Accordingly it may be seen that the tray of the present invention is prepared from a single blank of paperboard or the like wherein there is essentially no wasted material. The blank is generally rectangular in shape to produce a final product of rectangular shape. The corner connecting flaps and corner reinforcing flaps are cut and sized to cooperate with one another in the final assembly and remain connected to one another during use via novel connector elements. The novel arrangement of the parts of the tray permit the construction of a product that can be collapsed and stacked for shipping and storage, yet one which has highly useful top panels and corner reinforcing flaps for superior stacking strength when filled.

It is understood that changes in construction and different embodiments and applications of the invention may suggest themselves to those skilled in the art without departing from the spirit and scope of the invention as defined in the appended claims.

What is claimed is:

1. A tray with reinforced corners prepared from a single blank of material comprising:

(a) a substantially centrally located bottom panel of generally rectangular shape having side and end walls foldably attached to the ends thereof, said side and end walls having outer edges and ends, said end walls also containing diagonally oriented score lines which extend from their outer edges toward the corners of said bottom panel to permit the end wall to be folded inwardly when the end walls and side walls are collapsed onto the bottom panel for shipping and storage of the tray;

(b) a pair of top closure panels of abbreviated width foldably attached to the outer edges of the side wall panels, said top closure panels having ends;

(c) corner connecting flaps foldably attached to each end of each of the side wall panels which include integral locking tabs formed in the lower edges thereof by intersecting fold and cut lines; and, (d) corner reinforcing flaps foldably attached to each end of each top closure panel which include tab elements located at the outer ends thereof, the improvement wherein each of the corner connecting flaps and corner reinforcing flaps at each corner of the tray are spaced from one another along a majority of their adjacent edges by a slot and are temporarily connected to one another at their ends via integral connector elements when the tray is assembled, said flaps at each corner of the tray being separated from one another and folded adjacent to one aother to provide reinforced corners after the tray is filled, said tab elements engage slots provided thereof in the bottom panel when the reinforcing flaps and top panels are folded into their respective final positions at each corner, said integral locking tabs engage the edges of said corner reinforcing flaps adjacent to their tab elements for retaining the corner reinforcing flaps in place at each corner, and said end walls each include openings located adjacent to the corner connecting flap locking tabs which permit access to and manipulation of the locking tabs from outside the tray to urge the locking tabs into engagement with the edges of the corner reinforcing flaps.

* * * * *